US005844187A

United States Patent [19]

Thornton

[11] Patent Number: 5,844,187

[45] Date of Patent: Dec. 1, 1998

[54] SINGLE PIECE ARCING CONTACT FOR A CIRCUIT BREAKER

[75] Inventor: Keith J. Thornton, Powder Springs, Ga.

[73] Assignee: Siemens Energy & Automation, Inc., Alpharetta, Ga.

[21] Appl. No.: 989,319

[22] Filed: Dec. 12, 1997

[51] Int. Cl.[6] ..... H01H 33/14; H01H 9/40

[52] U.S. Cl. ..... 218/6; 218/1; 218/148; 335/201

[58] Field of Search ..... 218/1, 4, 6, 7, 218/16, 21, 36, 40, 148; 335/201

[56] References Cited

U.S. PATENT DOCUMENTS

| | | |
|---|---|---|
| 4,019,097 | 4/1977 | Miller et al. . |
| 4,484,045 | 11/1984 | Seymour et al. . |
| 4,595,896 | 6/1986 | DiMarco et al. . |
| 4,882,556 | 11/1989 | Fujii et al. . |
| 4,970,481 | 11/1990 | Arnold et al. . |
| 4,973,805 | 11/1990 | Paton et al. . |

*Primary Examiner*—Lincoln Donovan

[57] ABSTRACT

A circuit breaker having a movable load contact arm (14'), which pivots between an open position and a closed position, and a stationary line contact arm (16'). The circuit breaker includes an arcing contact structure (210) which is pivotally mounted on the stationary line contact arm. The arcing contact structure is generally "J" shaped, having a straight portion and a curved portion. The straight portion includes a bearing surface (211) which engages a bearing surface (221) on the bottom side of the line contact arm. The curved portion of the arcing contact extends beyond the end of the line contact arm and includes an electrical contact (212) which extends above the line contact arm when the load contact arm is in the open position. The arcing contact structure includes a biasing spring (214) which biases the arcing contact toward the load contact arm when the load contact arm is in the open position but allows the load contact arm to engage both the arcing contact structure and the electrical contact on the load contact arm when the load contact arm is in the closed position. As the load contact arm moves from the closed position to the open position, the spring urges the arcing contact structure to maintain an electrical connection with the electrical contact on the load contact arm as the load contact arm breaks electrical connection with the line contact arm. By breaking electrical contact with the load contact arm after the line contact arm has broken electrical contact with the load contact arm, electrical arcing between the electrical contacts on the load contact arm and line contact arm are significantly reduced.

8 Claims, 3 Drawing Sheets

SINGLE PIECE ARCING CONTACT FOR A CIRCUIT BREAKER

FIELD OF THE INVENTION

The present invention relates to electrical contacts of circuit breakers and in particular to an arcing contact attached to the contact arm of a circuit breaker to reduce damage to the electrical contact on the contact arm caused by electrical arcs.

BACKGROUND OF THE INVENTION

Damage to circuit breaker contact surfaces caused by electrical arcs may be a significant cause of failure especially in circuit breakers which are frequently switched between closed and open positions or which are frequently tripped. When the circuit breaker is switched or tripped to the open position while it is conducting electrical current, energy stored in the circuit that is being protected may cause potentially damaging electrical arcs between the circuit breaker contacts as they are separating. The arcs produced and, thus, the damage done may be especially severe if the load that is being protected by the breaker includes inductive elements such as motor windings.

The damage caused by these electrical arcs may be especially significant if the circuit breaker contacts are formed from a soft metal such as silver. Typically, at least one of the line and load contacts of a circuit breaker are formed from such a soft metal to ensure that a good electrical contact is made when the circuit breaker is closed.

Furthermore, the damage may be more severe for a circuit breaker which is frequently tripped because, typically, a circuit breaker is tripped only when the current flowing through the circuit breaker is excessive. When this excessive current is switched, the resulting electrical arcs may be more energetic and, thus, more damaging than arcs that are produced by manually switching the circuit breaker between the closed and open positions.

SUMMARY OF THE INVENTION

The present invention is embodied in a single-piece arcing contact for a circuit breaker. The exemplary arcing contact is mechanically and electrically coupled to the stationary line contact arm of a circuit breaker. The arcing contact is also coupled to a biasing spring which, when the circuit breaker is in the open position, biases the arcing contact toward the movable load contact arm. In operation, as the circuit breaker is moved from the closed position to the open position, the biasing spring urges the arcing contact to follow the load contact on the movable load contact arm after the load contact has separated from the stationary line contact. When the load contact separates from the arcing contact, any electrical arcs are generated between the load contact and the arcing contact.

According to one aspect of the invention, the arcing contact is configured on the line contact arm to extend beyond the end of the line contact arm which includes the line contact.

According to another aspect of the invention, the arcing contact is generally "J" shaped, having a curved portion at one end and a straight portion at the other end, wherein the straight portion includes a bearing surface which engages a bearing surface on the underside of the line contact arm to both mechanically and electrically couple the arcing contact to the line contact arm.

According to another aspect of the invention the arcing contact includes a protrusion on its lower surface which engages a biasing spring. The biasing spring fits within an opening beneath the fixed line contact to retain the bearing surface of the arc contact to the bearing surface of the line contact arm and to bias the curved portion of the "J" shaped arc contact toward the load contact arm.

According to yet another aspect of the invention, the electrical contacts on the load contact arm and arcing contact are formed from a metal which is harder than the metal which forms the electrical contact on the line contact arm.

DETAILED DESCRIPTION

Figure 1:
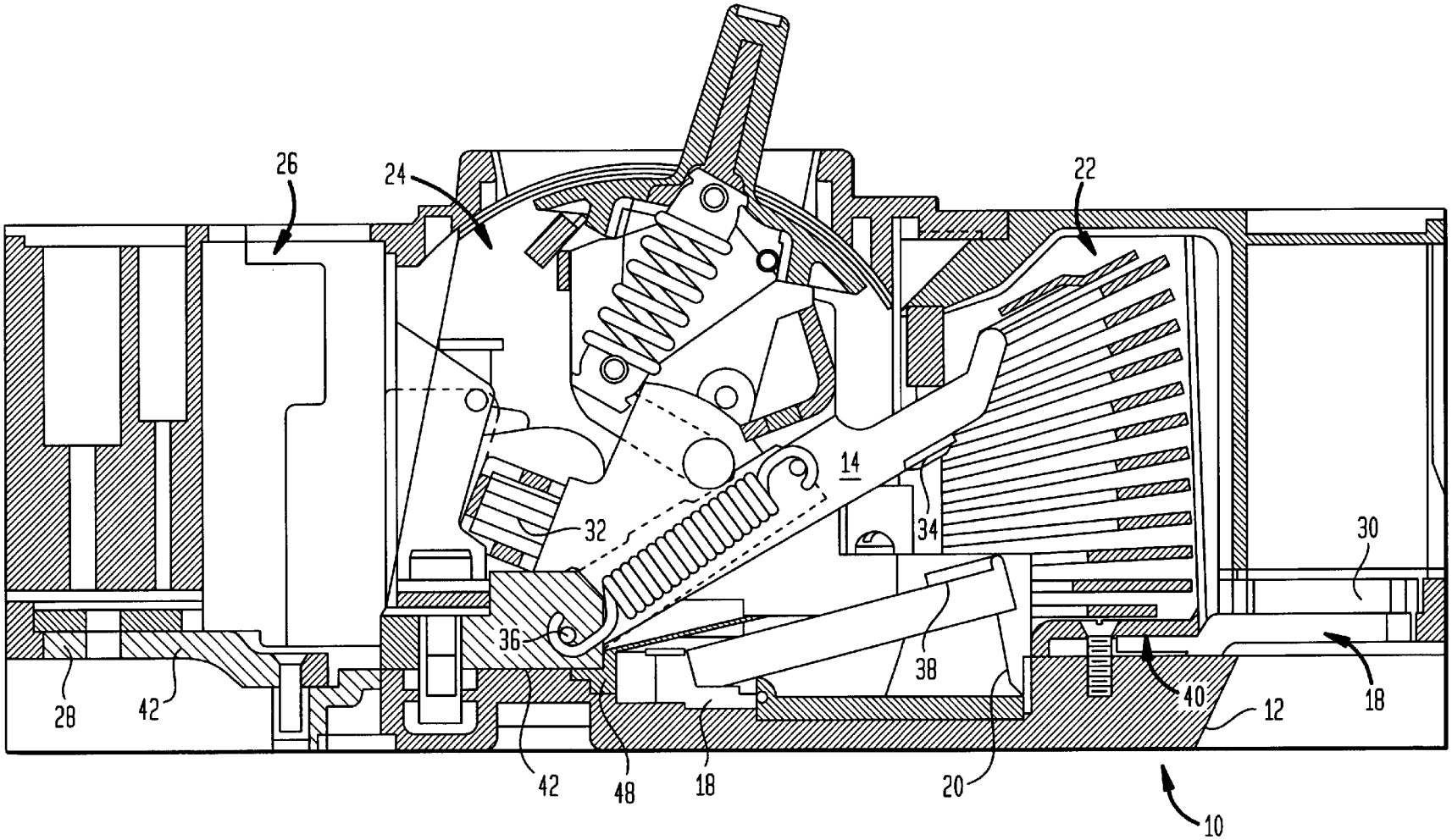
FIG. 1 (PRIOR ART)
FIG. 1, labeled "prior art" is a cutaway side plan view of a prior art circuit breaker.

FIG. 1 shows a prior art circuit breaker 10 which is contained in an insulating support base 12. The main components of the circuit breaker 10 are a pivoting upper contact arm 14 and a stationary lower contact arm 16. The lower contact arm is held in place by an insulating supporting structure 20 which is an integral part of the base 12 of the circuit breaker 10. The circuit breaker 10 also includes an arc chamber 22, an upper pivoting contact arm operating mechanism 24, a trip unit 26, a load terminal 28 and a line terminal 30.

The upper or load contact arm has a pivot hole (not shown) at one end and a conventional electrical contact 34 which is brazed or otherwise fastened to the contact arm at the other end. In FIG. 1, the load contact arm is shown as being contained in an insulating crossbar assembly 32. Although not shown, this crossbar 32 also contains load contact arms for two other poles of a three pole circuit breaker. Although the invention is described in terms of an exemplary embodiment in a three-pole circuit breaker, it is contemplated that it may be practiced in a single pole circuit breaker on in other multi-pole breakers.

The lower contact arm 16 is fixed in position, held in place by the support structure 20. When the breaker is closed, the crossbar assembly 32 rotates the load contact arm 14 in a clockwise direction about a pivot point 36 until the electrical contact 34 connects with the electrical contact 38 of the line contact arm 16.

In this configuration, current flows from the line terminal 30 through the line strap 18 to the line contact arm 16. In the exemplary embodiment of the invention, the line strap 18 and line contact arm 16 are formed from a single piece of metal. When the circuit breaker is closed, current flows through the line contact arm 16, through the electrical contacts 34 and 38 and through the load contact arm 14 to the load blade pivot 42. Current flows through the load blade pivot 42 to the trip unit 26 and then to the load terminal 28.

As described above, the electrical contacts 34 and 38 are located in the arc chamber 22. The arc chamber includes arc extinguishing grid plates which form multiple equipotential surfaces on the occurrence of an electrical arc in order to split a relatively large arc into multiple smaller arcs. In addition, the line strap 18 is covered with an arc insulator 40 as is passes beneath the arc chamber 22 in order to prevent unwanted arcing between the load contact arm 14 and the line strap 18. Finally, arc insulation 48 is provided between the load contact arm 14 and the line contact arm 16 to limit electrical arcs to the electrical contacts 34 and 38.

As described above, in a typical circuit breaker, one of the electrical contacts 34 and 38 is made from a soft metal which deforms slightly when the circuit breaker contacts 34 and 38 are closed. This deformation helps to ensure that a good electrical contact is made so that no resistive heating occurs in the contact area when the circuit breaker is closed. This soft metal contact, for example, line contact 38, however, is more susceptible to damage from arcing than the hard metal contact, for example, load contact 34.

Arcing occurs, as set forth above, when the circuit breaker contacts 34 and 38 are opened while current is flowing through the circuit breaker 10. This may occur in two ways. The circuit breaker may be manually opened while current is flowing or the circuit breaker may be tripped due to an overcurrent condition. In each of these instances, an electrical arc may be formed as the contacts 34 and 38 separate. While this arc may be partially quenched in the arc chamber 22, repetitive arcing may still damage at least the soft metal contact 38 such that it no longer makes a good electrical connection with the hard metal contact 34.

Figure 2A:
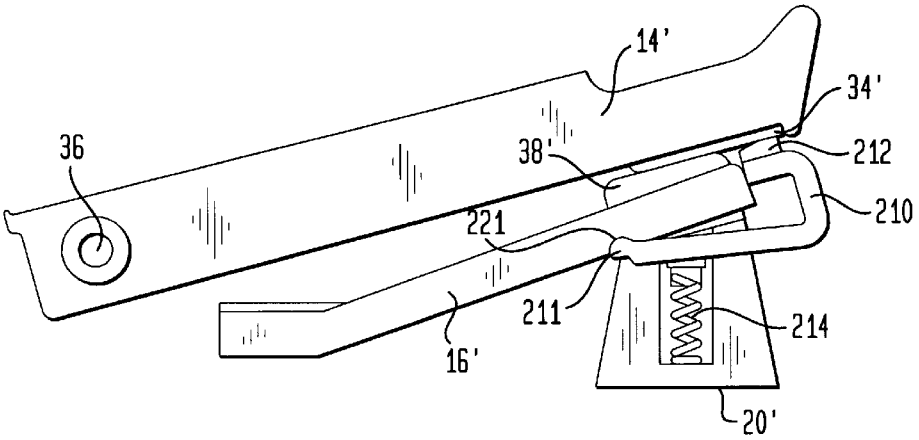
FIG. 2A is a partial side plan view of an exemplary contact structure in the closed state which includes an embodiment of the present invention.
Figure 2B:
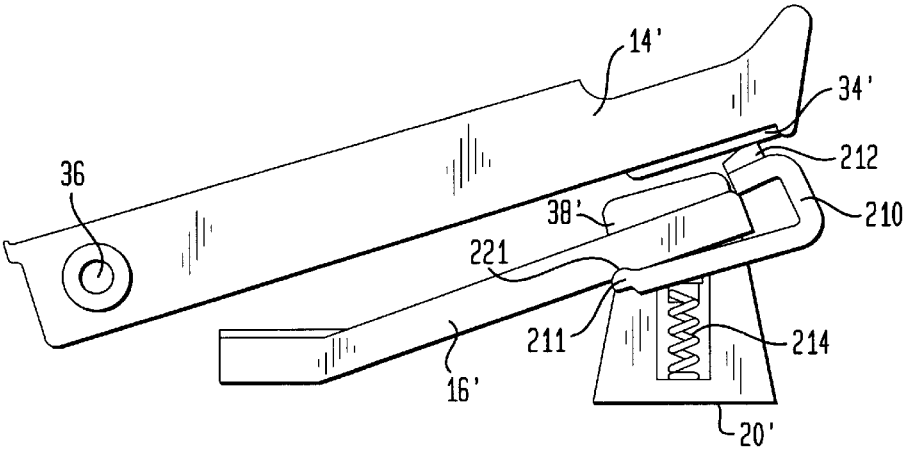
FIGS. 2B and 2C are partial side plan views of the contact structure shown in FIG. 2A in the "touch" state and the open state, respectively.
Figure 2C:
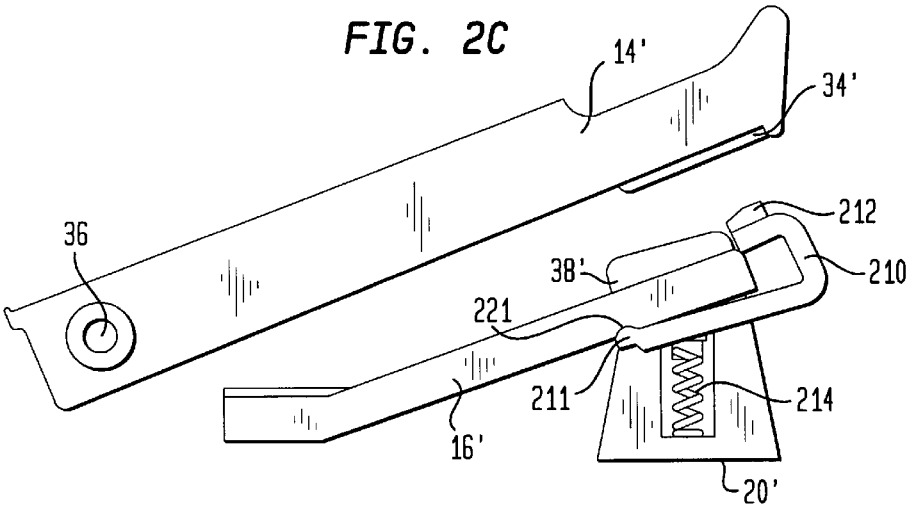

The present invention addresses this problem by adding a special arcing contact to the line contact arm 16. FIGS. 2A, 2B and 2C are cut-away side plan views of an exemplary contact structure according to the present invention respectively in the closed, touch and open positions. These views are cut along the centerline of the contact structure. The movable load contact arm 14' and stationary line contact arm 16' are similar to those shown in FIG. 1 except that the line contact arm 16' and line electrical contact 38' have been shortened relative to the contact arm 16 and electrical contact 38 shown in FIG. 1.

As shown in FIG. 2A, an arcing contact 210 has been added to the contact structure. This contact has a bearing surface 211 which engages a bearing surface 221 formed on the bottom surface of the line contact arm 38'. The body of the arcing contact 210 is formed from a single piece of metal, bent into a "J" shape. The contact 210 and includes a small electrical contact 212 which is brazed or otherwise attached to the body of the arcing contact. The contact structure includes a compression spring 214 which is held in the support structure 20' of the line contact arm as described below with reference to FIG. 4. The inside diameter of the spring 214 engages a protrusion (shown in FIGS. 3 and 5) on the bottom surface of the body of the arcing contact to mechanically couple the spring to the arcing contact. The force exerted by the compression spring 214 holds the bearing surface 211 of the arcing contact against the bearing surface 221 of the line contact arm and also biases the arcing contact 210 toward the load contact arm 14'.

FIG. 2A shows the exemplary contact structure in the fully closed position. In this position, the electrical contact 34' of the load contact arm 14' is pressed against the electrical contact 38' of the line contact arm 16'. The contact 34' also presses against the electrical contact 212 of the arcing contact 210. In this position, the primary current path is through the line contact arm 16', through the electrical contacts 38' and 34' and then through the load contact arm 14'. There is, however, a secondary current path through the line contact arm 16', arcing contact 210, electrical contacts 212 and 34' and then through the load contact arm 14'.

The configuration of the arcing contact 210 and spring 214 ensures that, as the circuit breaker contacts are opened, the secondary current path between the electrical contacts 212 and 34' continues even after the primary current path between the contacts 38' and 34' has been broken. As shown in FIG. 2B, when the line contact arm 14' pivots about the pivot axis 36 to open the circuit breaker, the biasing force of the spring 214 urges the arcing contact 210 to follow the load contact arm 14', maintaining electrical contact between the line contact arm 16' and the load contact arm 14' even after the electrical contacts 38' and 34' have been separated.

As shown in FIG. 2C, when the load contact arm pivots further, it breaks the conductive path between the arcing contact 210 and the load electrical contact 34'. It is when this electrical contact is broken that the largest and potentially most damaging electrical arcs are formed. Typically, these arcs extend from the arcing electrical contact 212 to the load electrical contact 34' and do not tend to affect the line electrical contact 38'. In the exemplary embodiment of the invention, only the line electrical contact 38' is formed from a soft metal, such as silver. The load electrical contact 34' and the arcing electrical contact 212 may be formed from a harder metal, for example, 50 percent silver, 50 percent tungsten. Because the highest voltage arcing conditions occur between these two relatively hard contacts, little damage is done. In addition, because the arcs occur on a portion of the load electrical contact 34' which does not engage the line electrical contact 38', they do not affect the quality of the connection that is made between the load contact 34' and the line contact 38' when the circuit breaker is closed.

Figure 3:
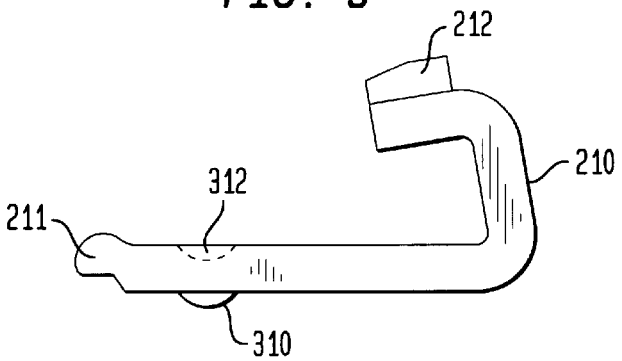
FIG. 3 is a side plan view of an exemplary arcing contact according to the present invention.

FIG. 3 is a side-plan view of the arcing contact 210. As shown in FIG. 3, the arcing contact has a "J" shape having a curved portion and a straight portion. The end of the curved portion includes the electrical contact 212 while the end of the straight portion includes the bearing surface 211. Also on the straight portion, a depression 312 is made on the inside surface of the arcing contact 210 to form a protrusion 310 on the outside surface of the contact. As described above, this protrusion matches the inside diameter of the compression spring 214 to hold the compression spring into engagement with the arcing contact 210.

Figure 4:
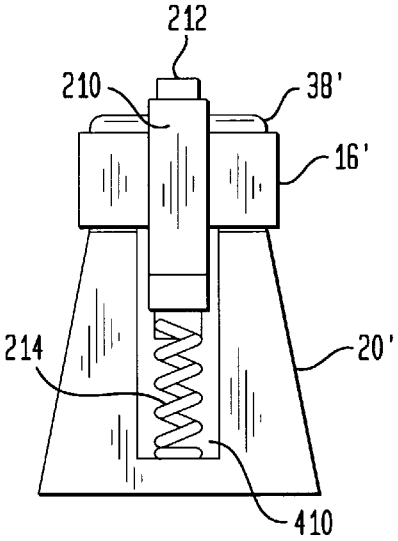
FIG. 4 is a partial end plan view of the line contact arm and arcing contact shown in FIG. 2C.

FIG. 4 is an end-plan view of the stationary line contact 16' with the arcing contact 210 in place. As shown in FIG. 4, the arcing contact 210 is narrower than the line contact 16' and fits within an opening 410 in the line contact support 20'. The biasing spring 214 also fits within the opening 410 and is anchored to the bottom wall of the opening. The inside diameter of the top of the spring 214 engages the protrusion 310 on the arcing contact as described above.

Figure 5:
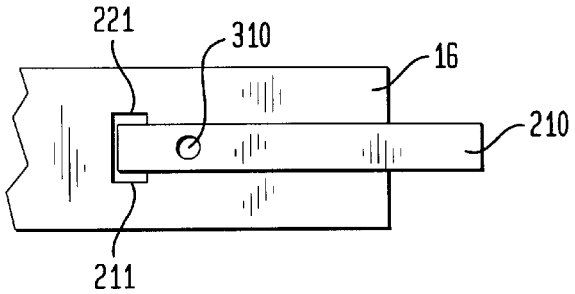
FIG. 5 is a partial bottom plan view of the line contact arm and arcing contact shown in FIGS. 2C and 4.

FIG. 5 is a bottom plan view of the stationary line contact 16' with the arcing contact 210 in place. This figure shows the relationship between the bearing surface 221 on the bottom of the stationary line contact 16' and the bearing surface 211 on the straight end of the "J" shaped arcing contact 210. As shown, the bearing surface 211 simply rests against the bearing surface 221, held in place by the compression spring 214.

Figure 6:
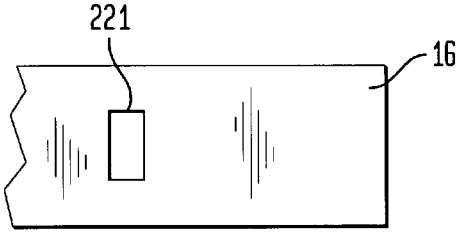
FIG. 6 is a bottom plan view of a line contact arm suitable for use with the arcing contact shown in FIG. 3.

FIG. 6 is a bottom plan view of the stationary line contact 16' with the arcing contact 210 removed. This figure shows the bearing surface 221 on the bottom of the line contact 16'.

This exemplary bearing surface is shallow, such that the upper portion of the bearing surface 211 is in full contact with the bearing surface 221 when the straight portion of the "J" shaped arcing contact is in full contact with the line contact arm 16'.

It is desirable to maintain good physical contact between the arcing contact 210 and the line contact arm 16' to ensure that an effective electrical conductive path exists between the arcing contact 210 and the line contact arm 16' as the circuit breaker is opened.

In addition to reducing arcing between the load contact 34' and the line contact 38' when the circuit breaker contacts are moved from an open position to a closed position, the arcing contact 210 also acts to reduce arcing related to "contact bounce" when the circuit breaker is closed. Contact bounce occurs due to the elastic nature of the electrical contacts 34 and 38. When these contacts are brought forcefully together, there is an initial elastic deformation which results in a counteracting force being exerted against the operating mechanism 24 (shown in FIG. 1). This counteracting force may separate the electrical contacts, causing an electrical arc to form between them. In some instances, when the current being switched is relatively high, the arcing that is caused by "contact bounce" may weld the line contact 38 to the load contact 34 making it difficult to open the contacts either manually or in a trip-fault condition. Because the arcing contact 210 maintains the electrical connection between the line contact arm 16' and the load contact arm 14' during the time interval when contact bounce occurs, there is less arcing between the line contact 38' and the load contact 34' and, thus, less chance of the contacts becoming damaged or welded together.

While the invention has been described in terms of an exemplary embodiment, it is contemplated that it may be practiced as outlined above within the scope of the appended claims.

What is claimed:

1. A contact structure for a circuit breaker comprising:

a load contact arm having first and second ends, the first end having an electrical contact and the second end having a pivot axis about which the load contact arm pivots between an open position and a closed position;

a line contact arm having an upper end containing an electrical contact which is configured to engage only a first portion of the electrical contact of the load contact arm when the load contact arm is in the closed position;

an arcing contact, having a generally "J" shape including a straight portion and a curved portion, the straight portion including a bearing surface by which the arcing contact is pivotally connected to the line contact arm at the upper end, and the curved portion including an electrical contact which engages a second portion of the electrical contact of the load contact arm when the load contact arm is in the closed position, a biasing spring, mechanically coupled to the arcing contact to maintain the connection between the arcing contact and the line contact arm and to bias the arcing contact toward the load contact arm;

whereby, when the circuit breaker switches from the closed position to the open position, the biasing spring urges the arcing contact to follow the load contact arm and to maintain an electrical connection with electrical contact of the load contact arm after the load contact has pivoted to a position at which the first portion of the electrical contact of the load contact arm does not engage the electrical contact of the line contact arm.

2. A contact structure according to claim 1, wherein the line contact arm has a lower surface, an end surface and an upper surface and the arcing contact is coupled to the line contact arm such that the straight portion extends along the lower surface and the curved portion extends beyond the end surface and above the upper surface when the load contact arm is in the open position.

3. A contact structure according to claim 2, wherein the arcing contact includes an inner surface and an outer surface, wherein the inner surface is adjacent to the lower surface of the line contact arm, the outer surface of the arcing contact including a protrusion which engages the biasing spring.

4. A contact structure according to claim 1, wherein the electrical contacts on the load contact arm and arcing contact are formed from a relatively hard metal while the electrical contact on the line contact arm is formed from a relatively soft metal.

5. A contact structure for a circuit breaker comprising:

a load contact arm having first and second ends, the first end having an electrical contact and the second end having a pivot axis about which the load contact arm pivots between an open position and a closed position;

a line contact arm having an lower surface, an end surface and an upper surface, and containing an electrical contact on the upper surface which is configured to engage only a first portion of the electrical contact of the load contact arm when the load contact arm is in the closed position;

an arcing contact, having a generally "J" shape including a straight portion and a curved portion, the straight portion including a bearing surface by which the arcing contact is pivotally connected to the line contact arm at the upper end, and the curved portion including an electrical contact which engages a second portion of the electrical contact of the load contact arm when the load contact arm is in the closed position wherein, the straight portion extends along the lower surface of the line contact arm and the curved portion extends beyond the end surface and above the upper surface of the line contact arm when the load contact arm is in the open position, a biasing spring, mechanically coupled to the arcing contact to maintain the connection between the arcing contact and the line contact arm and to bias the arcing contact toward the load contact arm;

whereby, when the circuit breaker switches from the closed position to the open position, the biasing spring urges the arcing contact to follow the load contact arm and to maintain an electrical connection with electrical contact of the load contact arm after the load contact has pivoted to a position at which the first portion of the electrical contact of the load contact arm does not engage the electrical contact of the line contact arm.

6. A contact structure according to claim 5, wherein the arcing contact includes an inner surface and an outer surface, wherein the inner surface is adjacent to the lower surface of the line contact arm, the outer surface of the arcing contact including a protrusion which engages the biasing spring.

7. A contact structure for a circuit breaker comprising:

a load contact arm having first and second ends, the first end having an electrical contact formed from a relatively hard metal and the second end having a pivot axis about which the load contact arm pivots between an open position and a closed position;

a line contact arm having an upper end containing an electrical contact formed from a relatively soft metal, the electrical contact being configured to engage only a first portion of the electrical contact of the load contact arm when the load contact arm is in the closed position;

an arcing contact, having a generally "J" shape including a straight portion and a curved portion, the straight portion including a bearing surface by which the arcing contact is pivotally connected to the line contact arm at the upper end, and the curved portion including an electrical contact formed from the relatively hard metal which engages a second portion of the electrical contact of the load contact arm when the load contact arm is in the closed position, a biasing spring, mechanically coupled to the arcing contact to maintain the connection between the arcing contact and the line contact arm and to bias the arcing contact toward the load contact arm;

whereby, when the circuit breaker switches from the closed position to the open position, the biasing spring urges the arcing contact to follow the load contact arm and to maintain an electrical connection with electrical contact of the load contact arm after the load contact has pivoted to a position at which the first portion of the electrical contact of the load contact arm does not engage the electrical contact of the line contact arm, such that a principal arcing path is formed between the electrical contact of the load contact arm and the electrical contact of the arcing contact.

8. A contact structure according to claim 7 where the relatively soft metal is silver and the relatively hard metal is an alloy of fifty percent silver and fifty percent tungsten.

* * * * *